US007918943B2

(12) United States Patent
Tameishi et al.

(10) Patent No.: US 7,918,943 B2
(45) Date of Patent: Apr. 5, 2011

(54) DISH WASHER

(75) Inventors: Yoshimasa Tameishi, Toyoake (JP); Tomio Suyama, Toyoake (JP); Tadaharu Hosogi, Toyoake (JP)

(73) Assignee: Hoshizaki Denki Kabushiki Kaisha, Aichi-Ken (JP)

( * ) Notice: Subject to any disclaimer, the term of this patent is extended or adjusted under 35 U.S.C. 154(b) by 335 days.

(21) Appl. No.: 11/795,172

(22) PCT Filed: Jan. 14, 2005

(86) PCT No.: PCT/JP2005/000392

§ 371 (c)(1), (2), (4) Date: Jul. 12, 2007

(87) PCT Pub. No.: WO2006/075385

PCT Pub. Date: Jul. 20, 2006

(65) Prior Publication Data

US 2008/0092933 A1 Apr. 24, 2008

(51) Int. Cl.
*B08B 3/00* (2006.01)

(52) U.S. Cl. ..... 134/56 D; 134/57 D

(58) Field of Classification Search ..... 134/56 D
See application file for complete search history.

(56) References Cited

FOREIGN PATENT DOCUMENTS

| | | |
|---|---|---|
| JP | 50-54533 | 5/1975 |
| JP | 62-143469 | 9/1987 |
| JP | 6-48566 | 7/1994 |
| JP | 9-122062 | 5/1997 |
| JP | 10-155717 | 6/1998 |
| JP | 11-128144 | 5/1999 |
| JP | 11-278406 | 10/1999 |
| JP | 11-285464 | 10/1999 |
| JP | 2000-254067 | 9/2000 |
| JP | 2003-15629 | 1/2003 |
| JP | 2003-135358 | 5/2003 |
| JP | 2004-135881 | 5/2004 |

OTHER PUBLICATIONS

Suyama, Koji, Feb. 1998, JP 11-285464, English machine translation.*

International Search Report (English language only) for PCT/JP2005/000392 mailed Feb. 15, 2005 (2 pages).

esp@cenet Patent Abstract JP11285464 dated Oct. 19, 1999 (1 page).

esp@cenet Patent Abstract JP9122062 dated May 13, 1997 (1 page).

esp@cenet Patent Abstract JP2004135881 dated May 13, 2004 (1 page).

Japanese Notice of Allowance for Japanese Application No. 2003-275530, mailed on Jun. 17, 2008 (2 pages).

esp@cenet patent abstract for Japanese Publication No. 2003015629, Publication date Jan. 17, 2003 (1 page).

esp@cenet patent abstract for Japanese Publication No. 2003135358, Publication date May 13, 2003 (1 page).

(Continued)

*Primary Examiner* — Michael Barr
*Assistant Examiner* — Jason Y Ko
(74) *Attorney, Agent, or Firm* — Osha Liang LLP

(57) ABSTRACT

In this dishwasher 1, a spring 33 utilized for moving a door 7 up and down is accommodated within a column 6 of a washer body 2, so as to be confined within the column 6, whereby the appearance becomes better while the spring 33 is protected against water. Also, the space between left and right columns 6, 6 can be utilized as a washing chamber 3, thus making it possible to expand the washing chamber 3, whereby the dishwasher can be made smaller while keeping the capacity of the washing chamber 3.

5 Claims, 7 Drawing Sheets

OTHER PUBLICATIONS
esp@cenet patent abstract for Japanese Publication No. 11276406, Publication date Oct. 12, 1999 (1 page).
esp@cenet patent abstract for Japanese Publication No. 10155717, Publication date Jun. 16, 1998 (1 page).
esp@cenet patent abstract for Japanese Publication No. 11128144, Publication date May 18, 1999 (1 page).
esp@cenet patent abstract for Japanese Publication No. 2000254067, Publication date Sep. 19, 2000 (1 page).
Notification of Transmittal of Copies of Translation of the International Preliminary Report on Patentability (Chapter I or Chapter II of the Patent Cooperation Treaty) for International Application No. PCT/JP2005/000392, mailed on Jul. 26, 2007 (5 pages).
Partial translation for Japanese Publication No. 54533/1975, Publication date May 24, 1975 (1 page).

* cited by examiner

DISH WASHER

TECHNICAL FIELD

The present invention relates to a dishwasher of so-called door type in which a washing chamber on the washer body side is opened and closed by moving a door up and down.

BACKGROUND ART

Japanese Patent Application Laid-Open No. HEI 11-285464 has conventionally been known as a technique in such a field. The dishwasher described in this publication is a so-called door type dishwasher in which a washing chamber is opened and closed by moving a handle up and down. This dishwasher utilizes a plurality of springs for smoothly moving the door up and down. The upper ends of the springs are attached via hooks to their corresponding lever parts fixed to a horizontal bar joining left and right arms to each other, while the lower ends of the springs are attached to the rear panel of the dishwasher via hooks. The springs are arranged in a row along the back face of the rear panel of the washing chamber, while being separated from the washing chamber so as to be protected against water.

Patent Document 1 Japanese Patent Application Laid-Open No. HEI 11-285464

DISCLOSURE OF THE INVENTION

Problem to be Solved by the Invention

In the above-mentioned conventional dishwasher, however, the springs are arranged in a row along the back face of the rear panel of the washing chamber, which makes it necessary to provide a space for accommodating the springs between the rear panel of the washing chamber and the rear panel of the dishwasher itself, thereby limiting the space occupied by the washing chamber, thus causing a problem that the washing chamber is smaller as compared with its greater appearance.

It is an object of the present invention to provide a dishwasher which makes it easy to increase the size of a washing chamber while protecting springs against water.

Means for Solving Problem

The dishwasher in accordance with the present invention is a dishwasher adapted to open and close a washing chamber provided on a washer body side by moving a door up and down while rotating a rotary arm arranged on a side face of the door, the dishwasher comprising a pair of left and right columns provided at both corner parts on a rear side of the washer body, and springs vertically accommodated in the respective columns, each spring having an upper end attached to a base side of the rotary arm and a lower end attached to the washer body side.

In this dishwasher, a spring utilized for moving the door up and down is accommodated within a column in the washer body, so as to be confined within the column, which makes the appearance better while protecting the spring against water, and improves sanitation since washing water and rinse water are hard to attach to the spring. Also, the space between the left and right columns can be utilized as a washing chamber, thus making it possible to expand the washing chamber, whereby the dishwasher can be made smaller while keeping the capacity of the washing chamber.

EFFECT OF THE INVENTION

The present invention can easily increase the size of the washing chamber while protecting the springs against water.

EXPLANATIONS OF NUMERALS

1 . . . dishwasher; 2 . . . washer body; 3 . . . washing chamber; 4 . . . mechanical chamber; 6 . . . column; 7 . . . door; 33 . . . spring; 34 . . . rotary arm; 36 . . . first fastening means; 43 . . . second fastening means; 44 . . . holder; 47 . . . rotary shaft; 51 . . . opening; 53 . . . stopper surface.

BEST MODES FOR CARRYING OUT THE INVENTION

In the following, a preferred embodiment of the present invention will be explained in detail with reference to the drawings.

Figure 1:
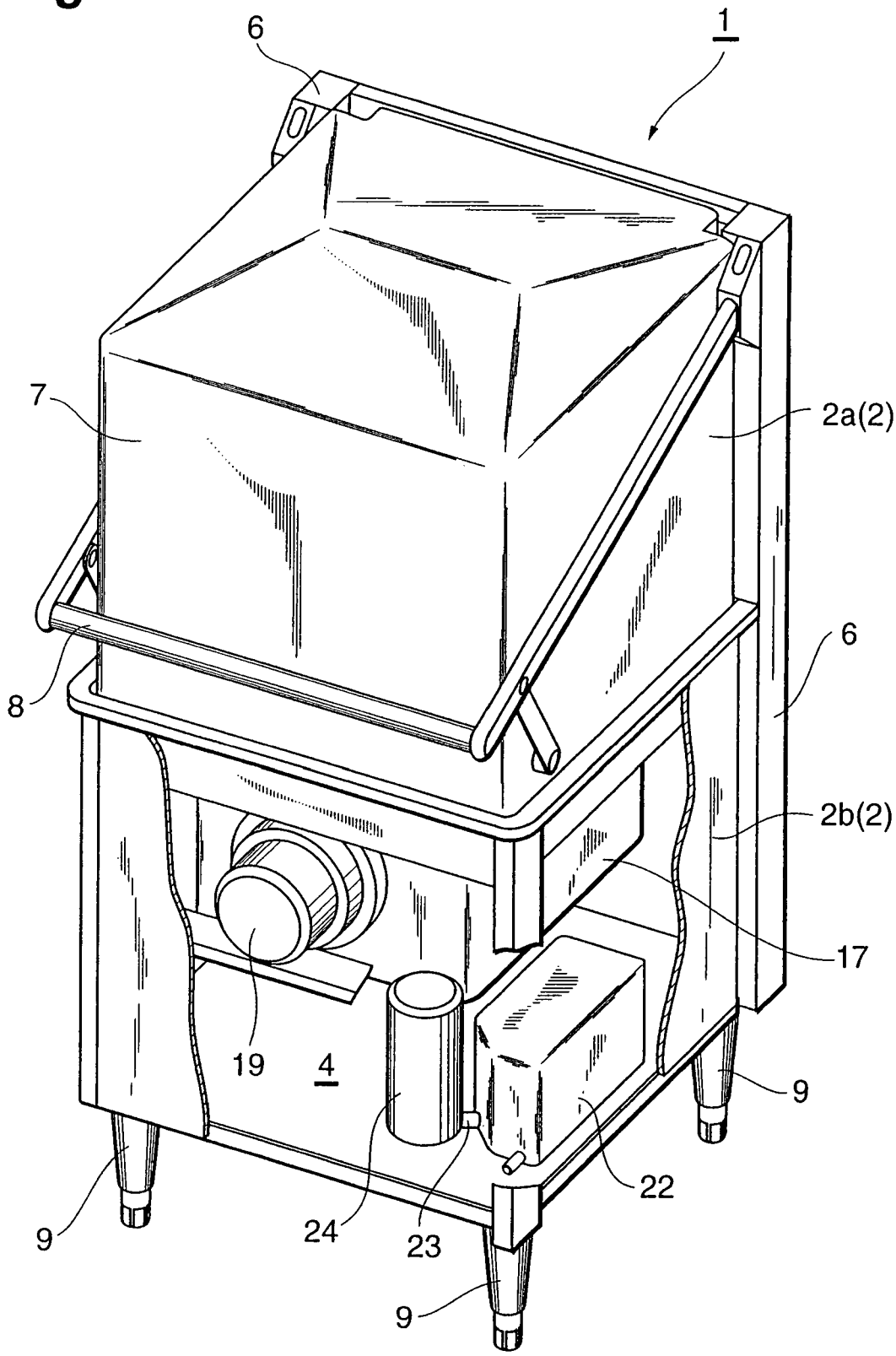
FIG. 1 is a perspective view showing an embodiment of the dishwasher in accordance with the present invention.
Figure 2:
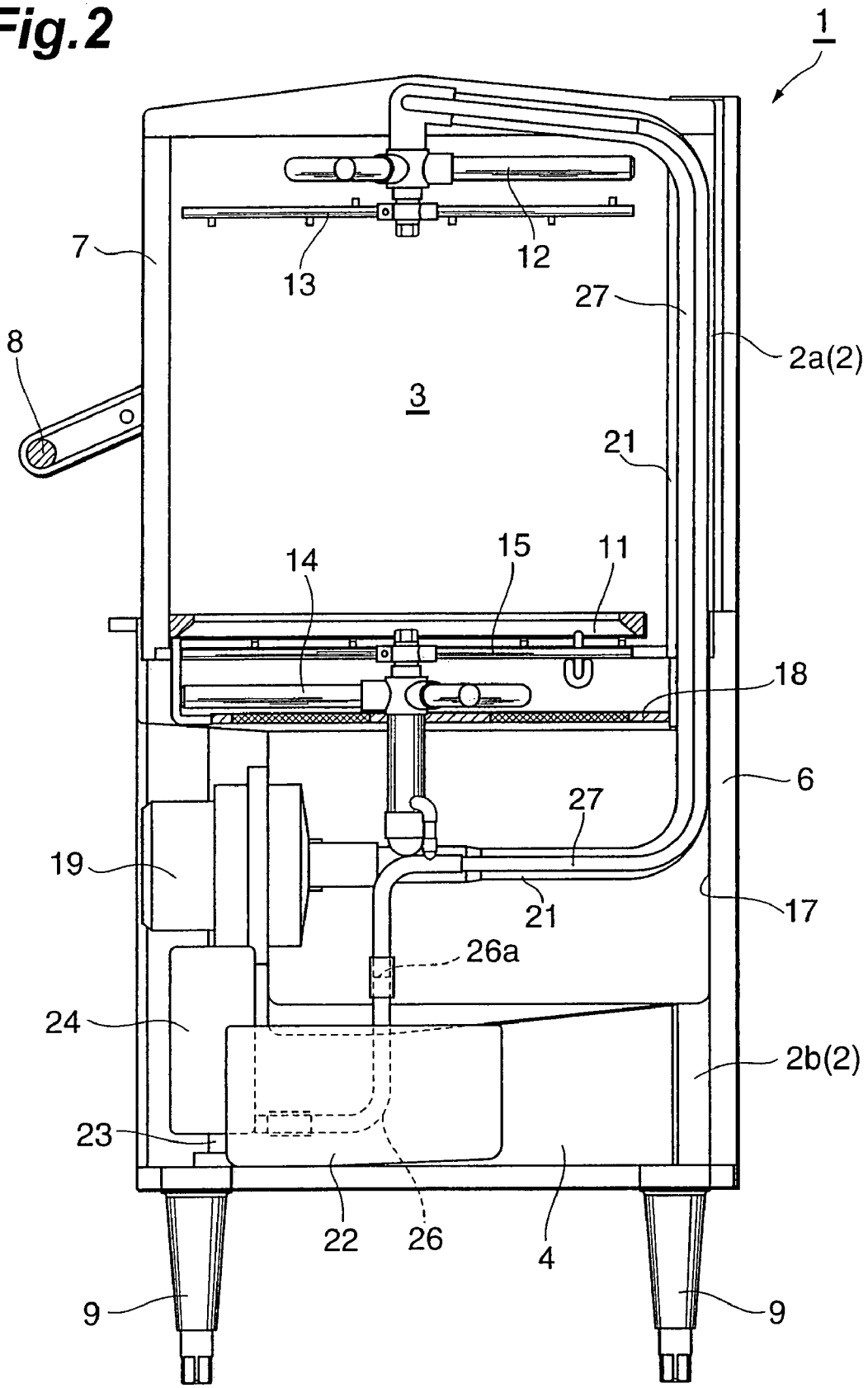
FIG. 2 is a vertical sectional view of the dishwasher shown in FIG. 1.

As shown in FIGS. 1 and 2, a dishwasher 1 has a washer body 2 made of stainless. The washer body 2 is partitioned into an upper part 2*a* formed with a washing chamber 3 and a lower part 2*b* formed with a mechanical chamber 4, whereas a pair of columns 6 extend over the upper part 2*a* and lower part 2*b* at corners of the body 2 on the back side. The upper part 2*a* of the washer body 2 is provided with a box-shaped door 7 for opening and closing the washing chamber 3. The door 7 is guided by the pair of columns 6 so as to be vertically movable, and is moved up and down by a handle 8 horizontally extending in front thereof, so as to open and close the washing chamber 3. Legs 9 are attached to the four corners of the bottom face of the washer body 2, whereby the dishwasher 1 can be installed stably.

A rack rail 11 is detachably arranged within the above-mentioned washing chamber 3, while a grid-like dish rack (not shown) arranged with dishes after drinking and eating is mounted on the rack rail 11. Further, an upper washing nozzle 12 having three radially extending arms and an upper rinsing nozzle 13 having two arms extending in a single line are rotatably arranged on the same axis in the upper part within the washing chamber 3. Likewise, a lower washing nozzle 14 and a lower rinsing nozzle 15 are rotatably arranged on the same axis in the lower part within the washing chamber 3.

At the bottom of the washing chamber 3 having such a structure, a washing water tank 17 is formed so as to project into the mechanical chamber 4, while a filter 18 is detachably arranged between the washing chamber 3 and the washing water tank 17. A washing water supply pump (hereinafter referred to as "washing pump") 19 is directly attached to the front face of the washing water tank 17 such that an inlet and an outlet are positioned within the washing water tank 17, thereby reducing the number of components and saving the space. A washing water conduit 21 is connected to the outlet of the washing pump 19, and travels through the washing pump 17 and washing chamber 3, so as to be connected to the upper washing nozzle 12 and lower washing nozzle 14.

Further, the mechanical chamber 4 contains therewithin a rinse water tank 22 to which rinse water is supplied from an external hot-water supply (not shown), while a rinse water supply pump (hereinafter referred to as "rinsing pump") 24 is connected to the rinse water tank 22 via an inlet pipe 23. The rinsing pump 24 is placed vertically with its impeller located on the lower side, thus effectively utilizing the space within the mechanical chamber 4. An outlet pipe 26 is connected to the outlet of the rinsing pump 24, while an end part 26*a* of the outlet pipe 26 extends into the rinse water tank 17. A rinse water conduit 27 is connected to the end part 26*a* of the outlet pipe 26, and passes through the washing water tank 17 and washing chamber 3, so as to be connected to the upper rinsing nozzle 13 and lower rinsing nozzle 15. The mechanical chamber 4 also contains therewithin an electric box (not shown) incorporating therein a microcomputer or the like for controlling overall operations of the dishwasher 1, and the like.

Operations of the above-mentioned dishwasher 1 will now be explained. When an operation start button is turned ON, the washing pump 19 starts. Consequently, the washing water retained within the washing water tank 17 is fed under pressure to the upper and lower washing nozzles 12, 14 through the washing water conduit 21, and is jetted from the washing nozzles 12, 14 to the dishes. At this time, each of the washing nozzles 12, 14 is rotated by a jet reaction force of the washing water, so that the washing water evenly impinges on the dishes, whereby stains are efficiently washed away from the dishes. The washing water jetted to the dishes is collected into the washing water tank 17 while contaminations such as vegetable debris are removed by the filter 18, and is recycled by the washing pump 19.

The washing pump 19 stops after performing such washing of the dishes for a predetermined time, and then the rinsing pump 24 starts. Consequently, the rinse water retained within the rinse water tank 22 is fed under pressure to the upper and lower rinsing nozzles 13, 15 through the rinse water conduit 27, and is jetted from the rinsing nozzles 13, 15 to the dishes. At this time, each of the rinsing nozzles 13, 15 is rotated by a jet reaction force of the rinse water, so that the washing water evenly impinges on the dishes, whereby the dishes are rinsed efficiently. The rinse water jetted to the dishes is collected into the washing water tank 17 through the filter 18, and is utilized as washing water in the next washing of dishes. The rinsing pump 24 stops after performing such rinsing of the dishes for a predetermined time, thereby completing one cycle of operations of the dishwasher 1.

Figure 3:
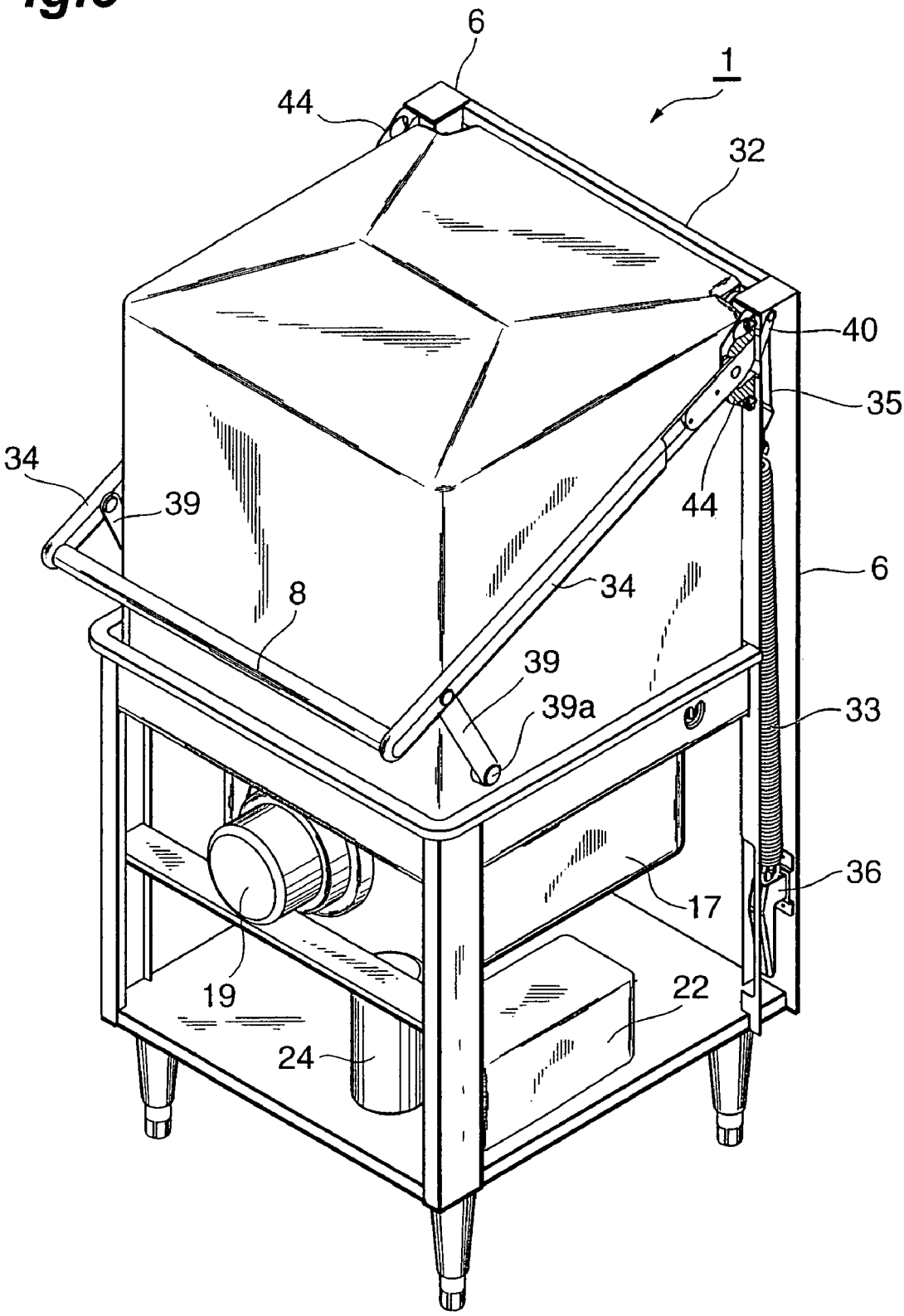
FIG. 3 is a perspective view with a cutaway of a main part of the dishwasher in accordance with the present invention.
Figure 4:
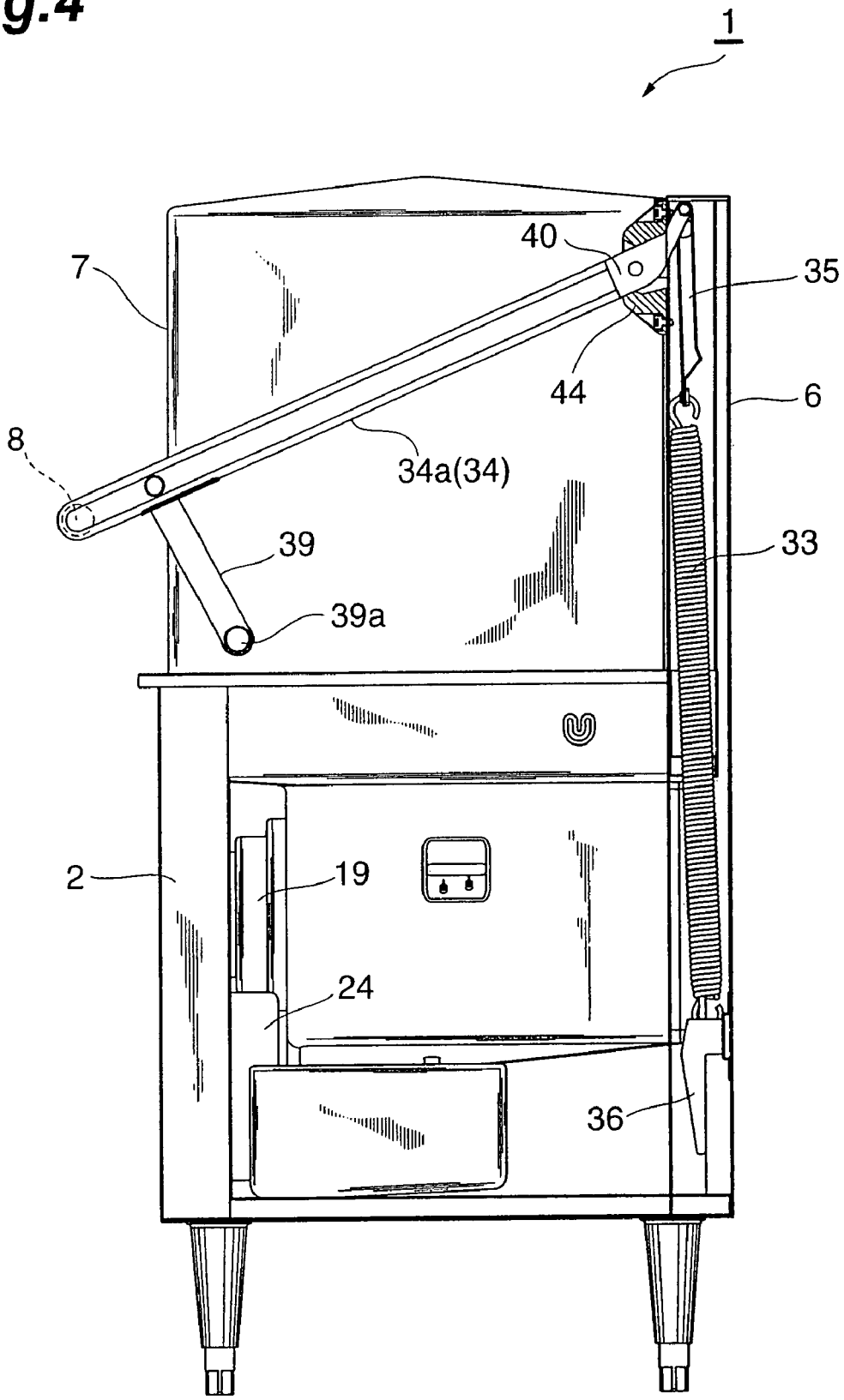
FIG. 4 is a perspective view with a cutaway of a main part of the dishwasher in accordance with the present invention.

As shown in FIGS. 3 and 4, the above-mentioned dishwasher 1 is mainly constituted by the stainless door 7 adapted to move up and down, and the washer body 2 accommodating the washing nozzles 12, 14, rinsing nozzles 13, 15, pumps 19, 24, and the like. The pair of left and right stainless columns 6, 6 are arranged at corner parts on the backside of the washer body 2, while a rear panel 32 made of stainless is secured by welding to the washer body 2 so as to join the left and right columns 6, 6 to each other. The rear panel 32 is utilized for forming the washing chamber 3 by cooperating with the door 7, and is firmly held by the columns 6 formed like rectangular pipes.

Within the column 6 formed like a rectangular pipe, a spring 33 to be utilized for opening and closing the door 7 is mounted so as to extend vertically. The upper ends of the springs 33, 33 are attached via joint parts 35 to the base sides of rotary arms 34, 34 which are arranged along side faces of the door 7. On the other hand, the lower end of each spring 33 is attached to the washer body 2 side via a toggle clamp (first fastening means) 36. The pair of left and right rotary arms 34, 34 are joined to each other by the handle 8 horizontally arranged along the front face of the door 7. Since the door 7 is required to move up and down in response to rotational movements of the handle 8, the rotary arms 34 are joined to the side faces of the door 7 via link parts 39, which are connected to the door 7 via axle pins 39*a*.

Thus accommodating the spring 33 within the column 6 can make the appearance very simple while protecting the spring against water, and improve sanitation, since the washing water and rinse water are prevented from contacting the spring. Also, the rear panel 32 bridging the left and right columns 6, 6 can effectively be utilized as a part of the washing chamber 3, which improves the space efficiency and makes it possible to expand the washing chamber 3, whereby the dishwasher 1 can be made smaller while keeping the capacity of the washing chamber 3.

Since the spring 33 is required to be attached to and detached from the rotary arm 34 as appropriate at the time of maintenance, a specific structure will be explained in the following.

Figure 5:
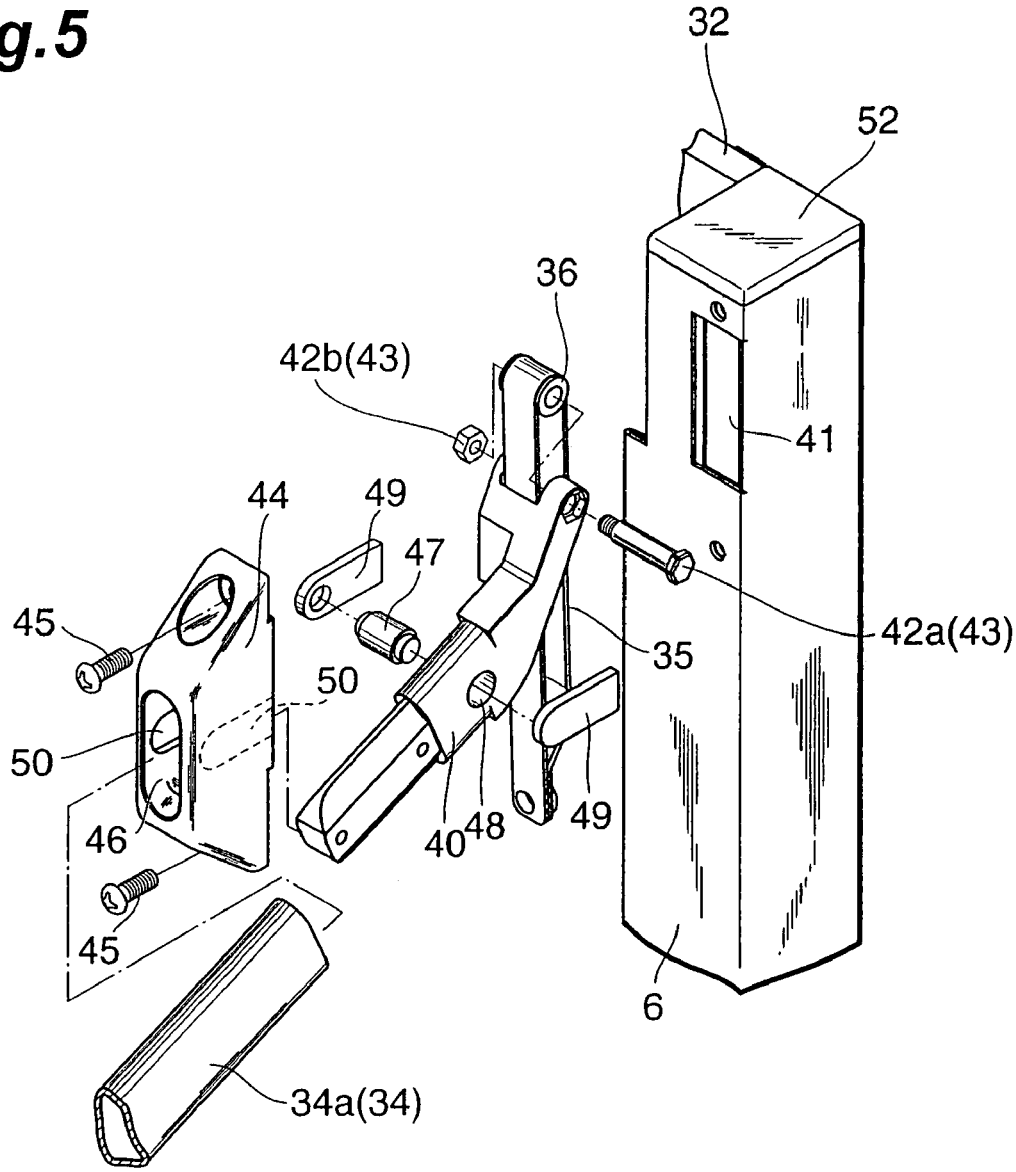
FIG. 5 is an exploded perspective view showing a main part of the dishwasher in accordance with the present invention.
Figure 6:
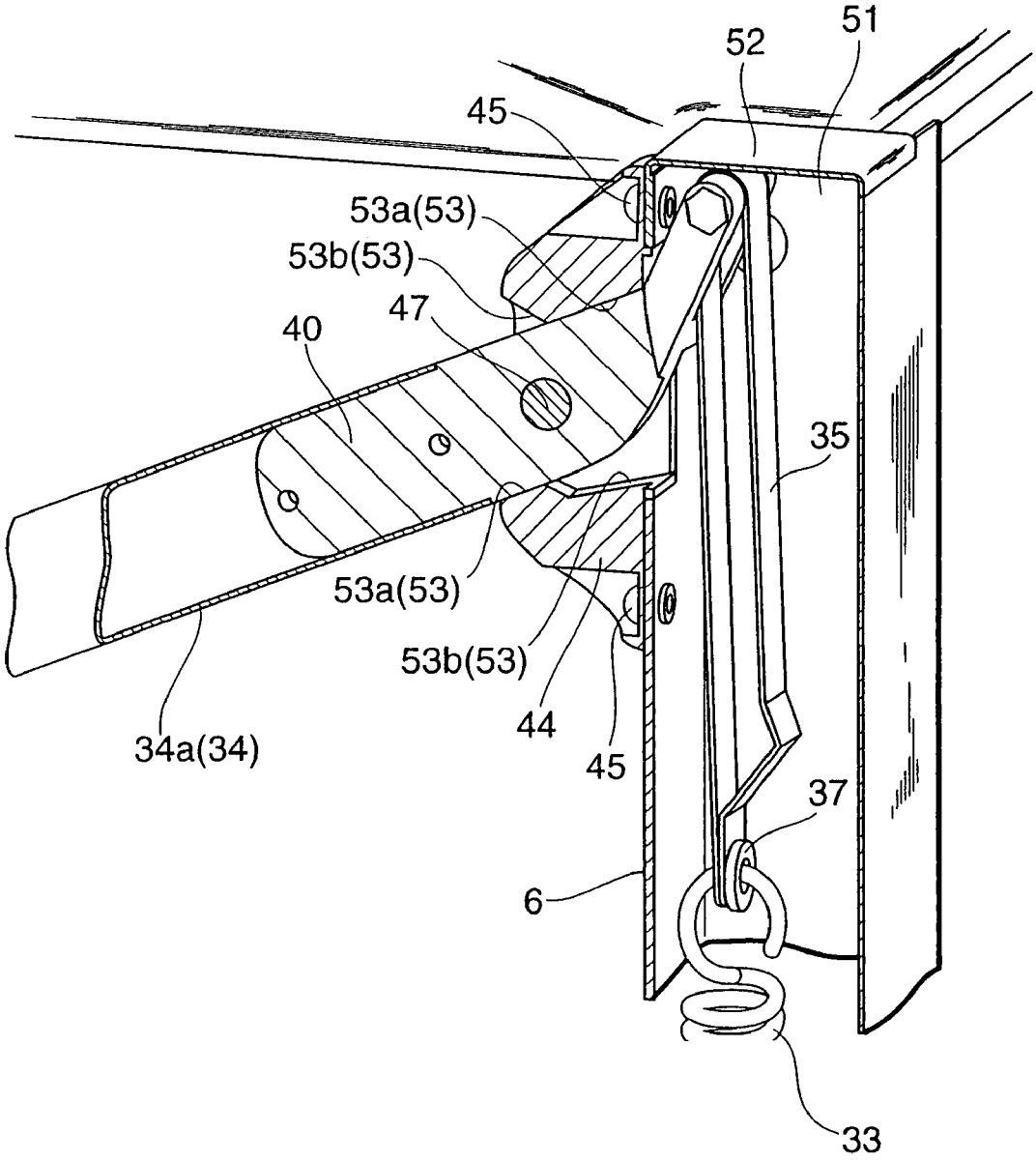
FIG. 6 is a perspective view showing a state after assembling the components shown in FIG. 5.

As shown in FIGS. 5 and 6, the upper end of the column 6 is provided with a rectangular opening 41 for inserting one end of a swinging part 40 positioned on the base side of the rotary arm 34. The joint part 35 is rotatably joined to the base end of the swinging part 40 via second fastening means 43 constituted by a bolt 42*a* and a nut 42*b*. The joint part 35 is used for making the spring 33 easy to follow movements of the swinging part 40, and has an elongated shape which is formed by a planar piece made of a metal and easy to deform elastically. A cylindrical bearing part 36 for inserting a bolt is provided at the upper end of the joint part 35, while the lower end of the joint part 35 is provided with an insertion hole 37 for engaging a hook part of the spring 33. The rear end of the swinging part 40 is bent like letter V so as to correspond to the thickness of the pipe-like column 6 but may be straight as well.

A holder 44 is mounted at the upper end of the column 6 so as to cover the rectangular opening 41 and is secured to the column 6 with screws 45. The holder 44 is formed with a communication hole 46 communicating with the opening 41. At the center of the swinging part 40 to penetrate through the communication hole 46, an axial hole 48 allowing a rotary shaft 47 to be inserted therein is formed, while both ends of the rotary shaft 47 are held by spacer plates 49, 49 made of a resin in view of dissembling/assembling operability. The spacer plate 49 in the state holding the rotary shaft 47 is inserted into a fitting groove 50, which is formed in an inner wall face of the holder 44, from the backside. As a result, the rotary shaft 47 is arranged within the holder 44, while the holder 44 and the swinging part 40 on the base side of the rotary arm 34 are rotatably joined to each other. Such a holder 44 produces a fulcrum of the rotary arm 34 near the column 6.

The rotary arm 34 is constituted by an arm body 34*a* and the swinging part 40 in view of easiness in assembling/dissembling, and is integrated by inserting the leading end of the swinging part 40 into the pipe-like arm body 34*a*. An opening 51 for removing and inserting a spring is formed at the upper end of the column 6. Utilizing the opening 51, the spring 33 can be removed from and inserted into the upper side of the column 6 at the time of maintenance, whereby operations can be made efficient. A lid 52 for preventing water and dirt from entering the inside of the column 6 is detachably attached to the opening 51.

As a result of providing the holder 44 with the rotary shaft 47, the fulcrum can be placed in front of the column 6. Therefore, when the rear and front ends of the rotary arm 34 joined to the spring 33 are load and effort points, respectively, the distance between the fulcrum and the load point can be set relatively long, so that the opening force of the door 7 increases, by which the spring 33 having a lower tension can be used. The spring 33 having a lower tension improves its durability and enhances its safety. The dishwasher 1 of a type which moves the door 7 up and down necessitates stopper means for restricting the range of rotation of the rotary arm 34.

Figure 7:
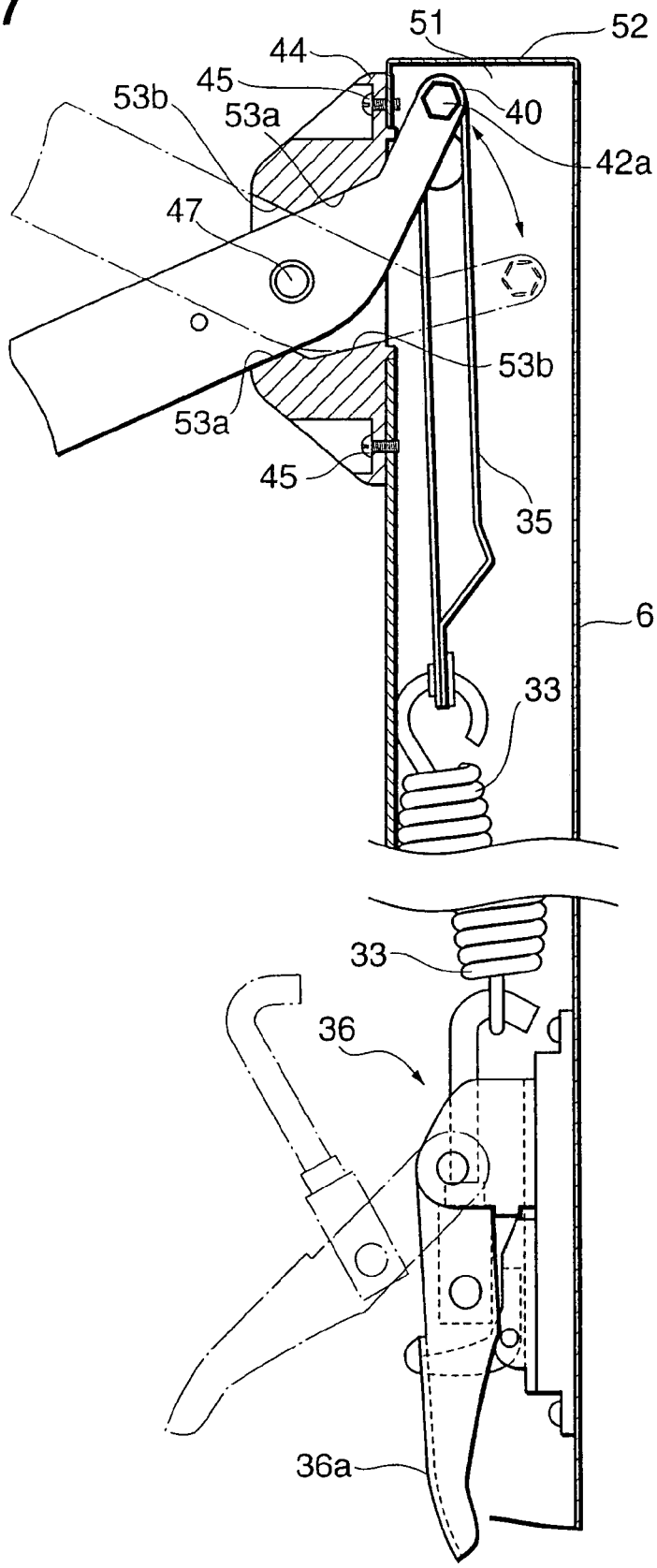
FIG. 7 is a sectional view showing a column and a holder.

Therefore, as shown in FIGS. 6 and 7, the wall face forming the communication hole 46 within the holder 44 is provided with a stopper surface 53. The stopper surface 53 restricts rotational range of the rotary arm 34 by abutting against the swinging part 40 of the rotary arm 34. The stopper surface 53 is constituted by a lower limit stopper surface 53*a* for determining a lower limit of the rotary arm 34 when closing the door 7 and an upper limit stopper surface 53*b* for determining an upper limit of the rotary arm 34 when opening the door 7. The lower limit stopper surface 53*a* extends obliquely downward on the lower side in front of the rotary shaft 47 and obliquely upward on the upper side therebehind. Likewise, the upper limit stopper surface 53*b* extends obliquely upward on the upper front side and obliquely downward on the lower rear side. Utilizing the above-mentioned holder 44 allows the stopper surface 53 to be made near the rotary shaft 47 where impact load is smaller when the rotary arm 34 rotates, whereby the door opening and closing structure can further be simplified.

The lower end of the spring 33 extends to the mechanical chamber 4 disposed in the lower part of the washer body 2, while being secured to a wall face of the column 6 by the toggle clamp (first fastening means) 36. Such a structure makes it easy to replace the spring 33, thereby allowing an operator to remove the lower end of the spring 33 from the washer body 2 easily by accessing from the mechanical chamber 4 side. When removing the upper end of the spring 33 from the joint part 35, the lower end of the spring 33 is initially detached from the toggle clamp 36 by raising the lever 36*a* of the toggle clamp 36. Thereafter, the arm body 34*a* is removed from the swinging part 40, and the swinging part 40 is pushed up such that the base end part of the swinging part 40 is seen through the opening 51. Then, the bolt 42*a* and nut 42*b* are removed, and the joint part 35 is lifted so as to be exposed from the opening 51, whereby the spring 33 can be pulled out from the column 6. The spring 33 is loaded into the column 6 by the reverse of the procedure mentioned above.

Whereas the dishwasher of a conventional type having a spring arranged on the backside of the washer body is required to be moved such as to be separated from the wall of a kitchen when replacing the spring, the dishwasher 1 of a type accommodating the spring 33 within the column 6 is not required to be moved, whereby its operability is excellent. Also, whereas the spring may wet at the time of replacing it in the dishwasher of the conventional type in which the spring is arranged on the backside of the washing chamber, there is no fear of wetting the spring 33 in the dishwasher 1 of the type accommodating the spring 33 within the column 6, whereby the operability is excellent.

The above-mentioned embodiment will be summarized as follows.

Preferably, the above-mentioned dishwasher further comprises a holder, provided at the upper end of the column, having the base side of the rotary arm penetrated therethrough; a rotary shaft rotatably joining the holder and rotary arm to each other within the holder; and a stopper surface, formed within the holder, for restricting a range of rotation of the rotary arm by abutting against the rotary arm. Such a structure can make the door opening and closing structure smaller and reduce the number of components. As a result of providing the holder with the rotary shaft, a fulcrum can be placed in front of the column. Therefore, when the rear and front ends of the rotary arm joined to the spring are load and effort points, respectively, the distance between the fulcrum and the load point can be set relatively long, so that the opening force of the door increases, by which the spring having a lower tension can be used. The spring having a lower tension improves its durability and enhances its safety. A dishwasher of a type which moves the door up and down necessitates stopper means for restricting the range of rotation of the rotary arm. Therefore, the present invention utilizes the holder, so as to make a stopper surface near the rotary shaft where impact load is smaller. This can further simplify the door opening and closing structure.

It will also be preferred if the lower end of the spring extends to the mechanical chamber disposed in the lower part of the washer body and is secured to the washer body by first fastening means, the upper end of the spring is secured to the base end of the rotary arm by second fastening means, and the upper end of the column is formed with an opening for removing and inserting a spring. Such a structure makes it easier to replace the spring. For example, an operator can easily remove the spring by detaching the lower end of the spring from the washer body while accessing from the mechanical chamber side, and then disengaging the upper end of the spring from the rotary arm from the opening side of the column. When loading the spring into the column, the spring can easily be loaded into the column by employing the first and second fastening means. Thus, the mechanical chamber side and the spring removing and inserting opening side of the column can be utilized when replacing the spring, which makes it unnecessary to move the dishwasher, while the spring is hard to wet, whereby the operability becomes excellent.

INDUSTRIAL APPLICABILITY

The present invention relates to a so-called door type dishwasher in which a washing chamber on the washer body side is opened and closed by moving a door up and down, and makes it easy to increase the size of the washing chamber while protecting springs against water.

The invention claimed is:

1. A dishwasher adapted to open and close a washing chamber provided on a washer body side by moving a door up and down while rotating a rotary arm arranged on a side face of the door, the dishwasher comprising:

a pair of pipe-like left and right columns provided at both corners on a rear side of the washer body; and springs vertically accommodated in the respective columns, each spring having an upper end attached to a base side of the rotary arm and a lower end attached to the washer body side, wherein the columns prevent wash water from contacting the springs.

2. A dishwasher according to claim 1, further comprising:

a holder, provided at an upper end of each column, having the base side of the rotary arm penetrated therethrough;

a rotary shaft rotatably joining the holder and rotary arm to each other within the holder; and a stopper surface, formed within the holder, for restricting a range of rotation of the rotary arm by abutting against the rotary arm.

3. A dishwasher according to claim 1, wherein the lower end of each spring extends to a mechanical chamber disposed in a lower part of the washer body and is secured to the washer body by first fastening means;

wherein the upper end of each spring is secured to the base side of the rotary arm by second fastening means; and wherein an upper end of each column is formed with an opening for removing and inserting a spring.

4. A dishwasher according to claim 2, wherein the lower end of each spring extends to a mechanical chamber disposed in a lower part of the washer body and is secured to the washer body by first fastening means;

wherein the upper end of each spring is secured to the base side of the rotary arm by second fastening means; and wherein an upper end of each column is formed with an opening for removing and inserting a spring.

5. A dishwasher according to claim 1, further comprising:

a rear panel arranged on a backside of the washer body and secured to the washer body so as to join the left and right columns to each other.

* * * * *